US006518522B1

(12) United States Patent
Vinard et al.

(10) Patent No.: US 6,518,522 B1
(45) Date of Patent: Feb. 11, 2003

(54) POSITION SENSOR WITH DIRECTING MECHANISM

(75) Inventors: Pierre Vinard, Valence (FR); José Rodriguez, Romans (FR); Bernard Truchet, Besayes (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 09/831,381

(22) PCT Filed: Nov. 16, 1999

(86) PCT No.: PCT/FR99/02807

§ 371 (c)(1),
(2), (4) Date: May 17, 2001

(87) PCT Pub. No.: WO00/30136

PCT Pub. Date: May 25, 2000

(30) Foreign Application Priority Data

Nov. 18, 1998 (FR) ..... 98 14481

(51) Int. Cl.[7] ..... H01H 13/06
(52) U.S. Cl. ..... 200/61.41; 200/302.2
(58) Field of Search ..... 200/61.41, 61.42, 200/61.58 R, 61.93, 47, 293, 329, 334, 573, 43.07

(56) References Cited

U.S. PATENT DOCUMENTS

RE27,016 E * 12/1970 Kiessling et al. ..... 200/47
4,556,768 A 12/1985 Atsumi et al.
5,207,316 A * 5/1993 Sakamoto ..... 200/47
5,894,116 A * 4/1999 Da Dalt ..... 200/334
5,929,404 A * 7/1999 Wecke et al. ..... 200/17 R
6,103,983 A 8/2000 Truchet et al.

* cited by examiner

*Primary Examiner*—Elvin Enad
*Assistant Examiner*—Lisa N Klaus
(74) *Attorney, Agent, or Firm*—Oblon, Spivak, McClelland, Maier & Neustadt, P.C.

(57) ABSTRACT

A position sensor for sensing the position of a moving part capable of actuating a plunger belonging to the sensor and more specifically a mechanism for orienting the plunger of the sensor. The sensor includes a guide that is rotationally orientable in a body about a first axis XX' of rotation, and a plunger sliding without rotation in the guide along the axis XX'. A locator prevents rotation of the guide in the body about the axis of rotation, in a given angular position. The locator is fixed nonremovably in the body and possesses either several tabs spaced regularly about the guide and capable of fitting into one position groove to immobilize the guide or several position grooves in which one tab can fit to immobilize the guide. Such a position sensor may find particular application in detecting the positions of moving mechanical components.

11 Claims, 4 Drawing Sheets

POSITION SENSOR WITH DIRECTING MECHANISM

FIELD OF THE INVENTION

The invention relates to a position sensor for sensing the position of a moving part capable of actuating a plunger belonging to the sensor. More specifically the invention discloses a mechanism for orienting the plunger of the sensor.

DESCRIPTION OF THE RELATED ART

A position sensor is a device designed to be actuated by a moving part, either because of the shape of its plunger or because of the force required to actuate it.

The position of the moving part is sensed by the mechanical action which the part exerts on the plunger when in contact with it.

Position sensors are usually fitted with miniature switches combining a reliable system of rapid switching with a sealed enclosure that confines the contacts in a neutral gas atmosphere favorable to the switching of low-level circuits up to high currents. The displacement of the plunger by the moving part actuates the miniature switch and closes or opens an electrical contact which signals the presence of the moving part.

The shape of that part of the plunger which comes into contact with the moving part is adapted both to the shape of the moving part whose position is to be detected and to the type of movement of the part. The reason for this is that, depending on the configuration of the mechanical system in which the sensor is inserted, the angle of attack defined between the direction of the movement of the moving part and the axis of the plunger, when contact occurs between the moving part and the plunger, can differ.

For example, if the displacement of the moving part is in the direction of the axis of the plunger, the free end of the plunger can simply be a hemispherical surface giving point contact with the moving part. With this same type of displacement, the free end of the plunger may be fitted with a ball able to pivot in the plunger in order to provide frictionless contact with the mechanical part, if the latter exhibits lateral movement with respect to the plunger axis.

In cases where the moving part exhibits a linear movement more or less at right angles to the plunger axis, the plunger comprises at its free end a roller oriented in the direction of movement of the part, the roller being integral with the plunger and being able to rotate about an axis of rotation perpendicular to the axis of the plunger.

FIG. 1*a* shows a partial section through a position sensor 10 according to the prior art, comprising a roller 12, a guide 14 that can be rotationally oriented about a first axis XX' of rotation, in a body 16 and a plunger 18 sliding without rotation in the guide 14 along this first axis XX'.

At the free end of the plunger is the roller 12 which is of circular cylindrical shape and can turn on a spindle or shaft 20 about a second axis YY' of rotation, this second axis YY' being colinear with the axis of revolution of the roller, and perpendicular to the first axis XX'.

When a moving part P travelling in a direction Dz approximately perpendicular to the first axis XX' and to the second axis YY' contacts the roller 12 on a point of its cylindrical surface situated above the second axis YY', a first force F1 is exerted by the moving part P on the periphery of the roller. This first force F1, transmitted to the plunger 18 through the shaft 20, produces a component force F2 in the direction of the first axis XX'. This component force F2 causes the plunger 18 to slide down the guide 14, and the roller 12 down two guide grooves 22 situated in the guide 14 on either side of the first axis XX'.

The sliding of the plunger down the guide takes place without rotation, the second axis YY' of rotation of the roller 12 being maintained in the same direction throughout the sliding of the roller in the guide grooves 22.

As it slides down the guide 14, displaced by the component force F2 towards the interior of the body, the plunger 18 actuates, via a rod 24, an electric microswitch 26. A return spring 28 is compressed during the displacement of the plunger towards the interior of the body. When the moving part P moves away from the roller, the plunger 18 is returned to its initial position by the return spring 28.

The body 16 of the position sensor is mounted on a frame (not shown in FIG. 1*a*) and is thus immobilized in its position with respect to the direction of displacement of the moving part. As a consequence the roller 12 must be able to be oriented and maintained in its angular position about the first axis XX' so that the second axis YY', about which the roller revolves, is essentially perpendicular to the direction Dz of the movement of the moving part whose position is to be detected. Having the roller oriented in the direction of movement of the moving part ensures that the roller turns properly on its spindle and avoids lateral loads during contact with the moving part.

To this end, the lower part of the guide 14 comprises position grooves 30 distributed around its periphery at an angular pitch a about the first axis XX'. At the upper end of the body 16, the sensor possesses a locator 32 which is fixed so that it cannot rotate in the body of the sensor and which is in the form of a washer with a tooth 34 designed to fit into one of the position grooves 30.

The body has a screwthread 35 on its cylindrical outer surface on which a nut 36 is screwed to clamp the guide 14 and the locator 34 firmly to the body 16.

FIG. 1*b* shows a perspective view of the guide 14 showing the position grooves 30 distributed around the periphery of the guide at-an angular pitch $\alpha$ of 45 degrees.

An angular position $\beta$ of the guide grooves 22, and consequently the angular position of the roller 12 sliding in these grooves with respect to a reference axis ZZ' of the sensor passing through the first axis XX' and through the middle of the tooth 34 of the locator 32, will consequently be determined by the selection of one of the position grooves 30, which contains the tooth 34.

The drawing of FIG. 1*c* shows a simplified top-down view of the sensor taken on AA', where the angular position $\beta$ of the guide grooves 22 is approximately 90 degrees with respect to the reference axis ZZ'. In this configuration the second axis YY' of the roller 12 shown in dashes in FIG. 1*c* will have turned through the angle $\beta$ of 90 degrees with respect to its position in FIG. 1*a*.

FIG. 2*a* shows a view of the principle of a position sensor 40 according to the prior art showing another mechanism for the angular positioning of a plunger 42 with respect to a fixed body 44 of the sensor.

The position sensor 40 comprises, as in the case of the sensor of FIG. 1*a,* a guide 46 that can be oriented rotationally about the first axis XX' in the body 44, with the plunger 42 sliding without rotation in the guide 46 along this first axis XX'.

In this embodiment the guide 46 has first holes 48 distributed radially with an angular pitch $\alpha$ about the first axis XX'. The axes of the holes all lie in the same plane perpendicular to the first axis XX', and each hole 48 can be lined up with the open end of a second hole 50 in the periphery of the body 44.

A locator in the form of a flexible circular collar 52 encircles the body 44 of the sensor around its periphery. FIG. 2*b* shows the collar 52 with a short rod 54 in its center which can be inserted into the second hole 50 of the body and into one of the first holes 48-1 of the guide lined up with the first. Selecting one of the second holes 48-2 and keeping it lined up with the first hole by means of the rod 54 ensures an angularly position β of the guide with respect to the sensor body.

The different mechanisms of angular positioning for sensors in the prior art have drawbacks as follows.

In operation, the sensor suffers impacts when contact occurs between the moving part and the roller. These repeated impacts produce vibrations in the sensor with the risk of loosening the locator from the sensor body. These vibrations can for example shake the collar 52 free from the sensor shown in FIG. 2*a* or slacken the nut 36 of the sensor shown in FIG. 1*a*.

The loosening of the locator and the failure to keep the guide in position in the sensor body means that the roller is no longer oriented and the position sensing function is therefore no longer performed, with the consequences which this can engender in systems requiring a high degree of reliability of operation.

SUMMARY OF THE INVENTION

It is an object of the invention to reduce the problems of the prior art by proposing a position sensor for sensing the position of a moving part comprising:

- a guide that is rotationally orientable in a body about a first axis XX' of rotation, and a plunger sliding without rotation in the guide along this axis XX';
- a locator that prevents rotation of the guide in the body about the first axis of rotation, in a given angular position, characterized in that the locator is fixed non-removably in the body and in that it possesses either several tabs spaced regularly about the guide and capable of fitting into one position groove to immobilize the guide or several position grooves in which one tab can fit to immobilize the guide.

In one embodiment of the position sensor according to the invention, the tab or tabs are designed to be bent to enable at least one tab to be inserted into a position groove of the guide, in order to prevent rotation of the guide in the body.

In a first variant of the sensor according to the invention, the locator possesses several tabs, two of these tabs bent, one into each of two position grooves of the guide thus preventing the guide from rotating in the body.

In another variant of the position sensor, the locator possesses one bendable tab and the guide several position grooves, the angular position of the guide being determined by the choice of one of the position grooves containing the single bent tab.

BRIEF DESCRIPTION OF THE DRAWINGS

Other characteristics and advantages of the invention will become apparent on reading the detailed description given thereof with reference to the attached drawings, in which:

FIG. 3*a* is a perspective view of a position sensor 60 according to the invention.

DETAILED DESCRIPTION OF THE PREFERRED EMBODIMENTS

Figure 1A:
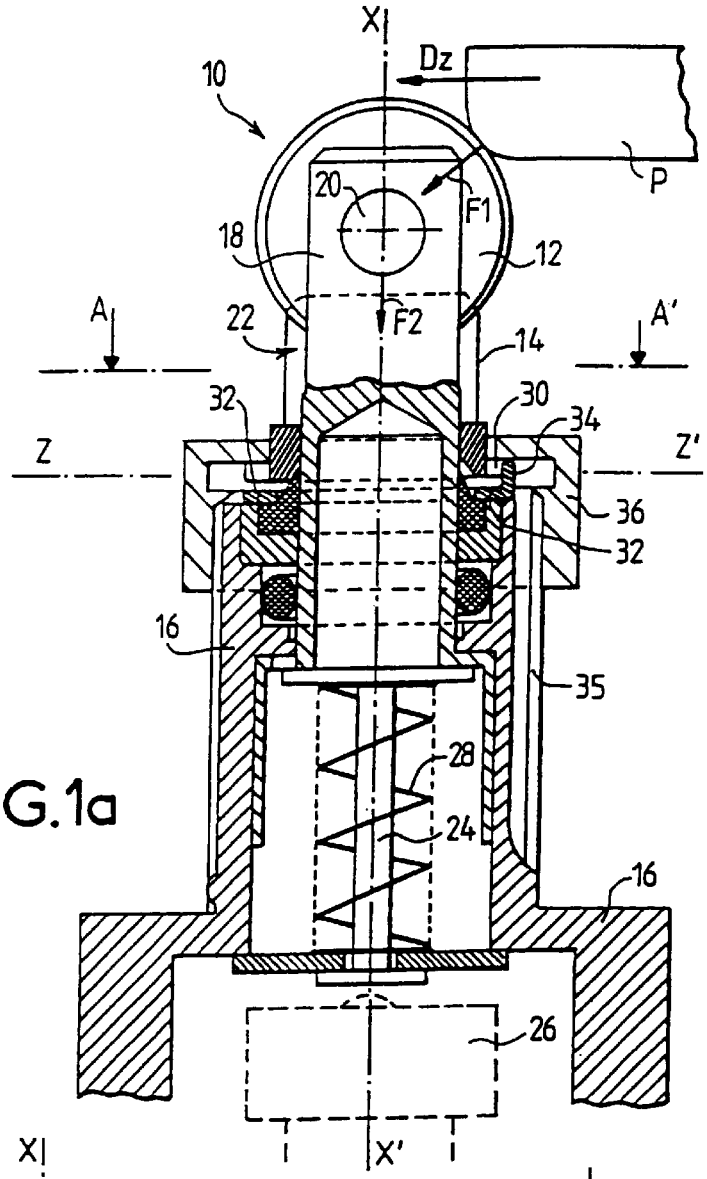
FIGS. 1*a,* 1*b,* already described, show a position sensor and its guide, respectively, according to the prior art.
Figure 1B:
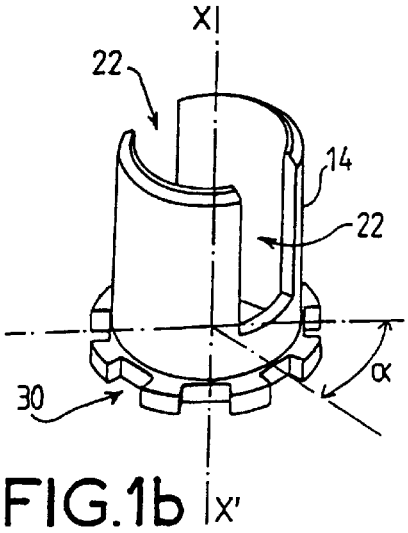
FIG. 1*c,* already described, is a simplified top-down view of the sensor shown in FIG. 1*a;*
Figure 1C:
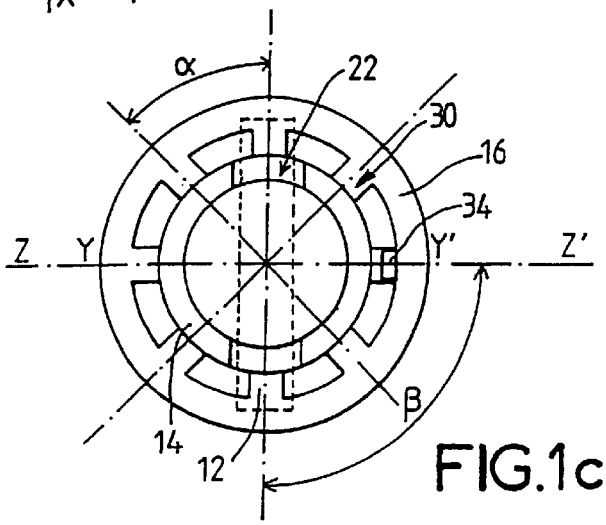
Figure 2A:
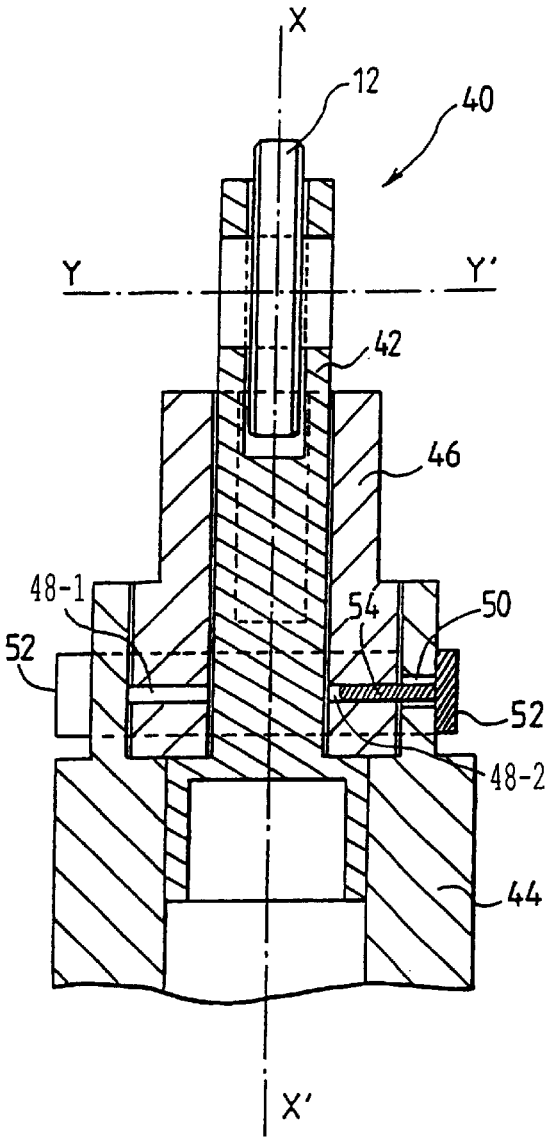
FIGS. 2*a* and 2*b,* already described, show another position sensor and its locator, respectively, according to the prior art.
Figure 2B:
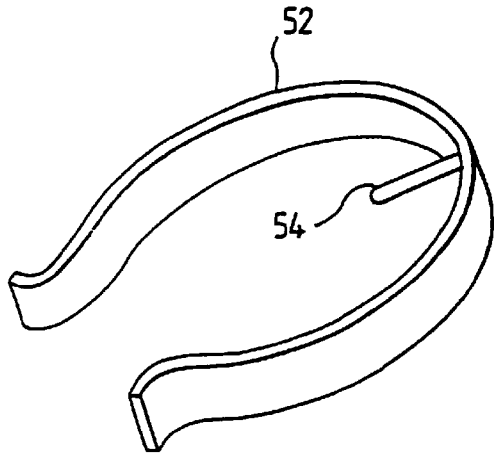

The sensor comprises a guide 62 that is rotationally orientable about the first axis XX' in a body 64 and a plunger 66 sliding without rotation in the guide 62 along the first axis XX'. As in the case of the position sensors shown in FIGS. 1*a* and 2*a,* the free end of the plunger projecting from the guide comprises the roller 12, which is able to turn about the spindle 20 of second axis YY' perpendicular to the first axis XX'.

Figure 3A:
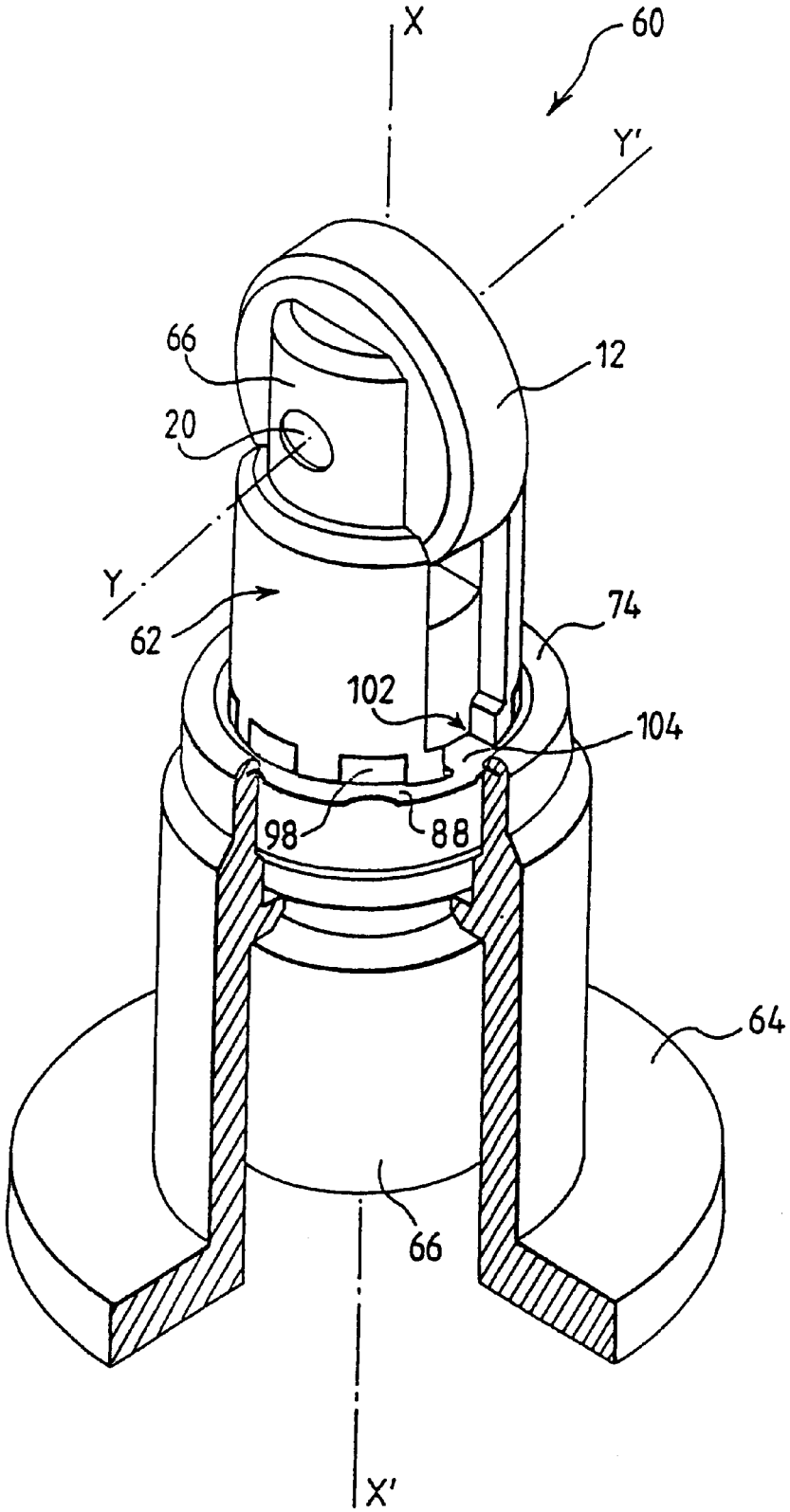
FIGS. 3*a* and 3*b* are a perspective view and a sectional view, respectively, of a position sensor according to the invention.
Figure 3B:
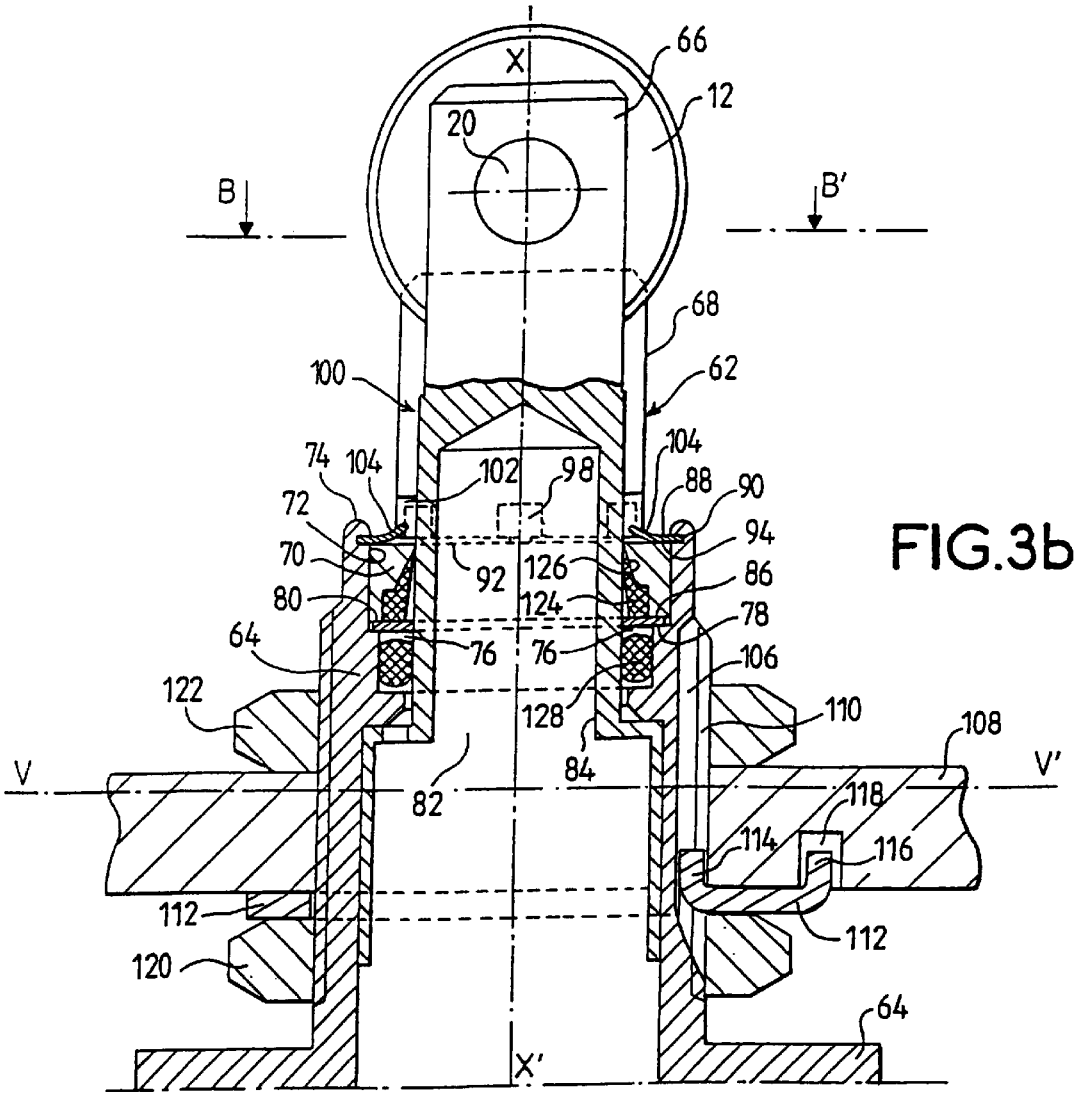

FIG. 3*b* shows a section through the position sensor shown in FIG. 3*a,* on a plane passing through the first axis XX' perpendicular to the second axis YY' of the roller 12.

The guide 62, which is of circular cylindrical shape, possesses an upper part 68 and a lower part 70, the upper part having a smaller diameter than the lower part which fits inside a first recess 72 in the body 64 of the sensor.

The first recess 72, which is of circular cylindrical shape and coaxial with the first axis XX', is open in one direction at one end 74 of the body 64, situated towards the free end of the plunger, and in the other direction to a second recess 76, coaxial with the first and of the same shape, with a diameter slightly smaller than that of the first recess, thus creating a circular shoulder 78 on which a washer 80 sits.

The second recess 76 is open to a third recess 82 through which a lower part 84 of the plunger 66 can pass as it slides inside the body 64.

The lower part 70 of the guide is applied, via a base surface 86 perpendicular to its axis of revolution, against the washer 80, thus keeping the guide in its longitudinal position on the first axis XX' in the body of the sensor.

A washer-like locator 88 possesses an outer edge 90 and an inner edge 92. The locator is crimped by its outer edge 90 into the body of the sensor, near its end 74, coaxially with the first axis XX'.

The locator 88 is crimped into the body 64 of the sensor in such a way as to clamp the cylindrical lower part 70 of the guide between the said locator resting on a circular surface 94 resulting from the intersection of the upper part 68 with the lower part 70 of the guide, and the washer 80. The guide is thus kept in its longitudinal position on the first axis XX', such that it cannot be removed from the body of the sensor, between the locator 88 and the washer 80.

Besides keeping the guide in its longitudinal position in the body of the sensor, the locator performs a second function of angular positioning in the body of the sensor about the first axis XX'.

For this purpose, the locator 88 possesses, on the one hand, notches 96 in its outer edge 90, in order to make it rotationally nonremovable once crimped into the body 64 and, on the other hand, tabs 98 on its inner edge 92, the tabs being spaced regularly at an angular pitch α about the first axis XX', the faces of the tabs being parallel to the cylindrical surface of the guide.

The sliding of the plunger 66 in the guide 62 takes place without rotation because the second axis YY' of the roller 12 is maintained in the same direction throughout the sliding of the plunger as the roller 12 slides in the upper part 68 of the guide, in two symmetrical guide grooves 100 situated on either side of the first axis XX'.

The two guide grooves 100 are continued towards the lower part 70 of the guide 62 as far as the circular surface 94, in the form of two position grooves 102 narrower than the guide grooves, and each of which can take one of the tabs 98 of the locator 88 after bending.

Figure 3C:
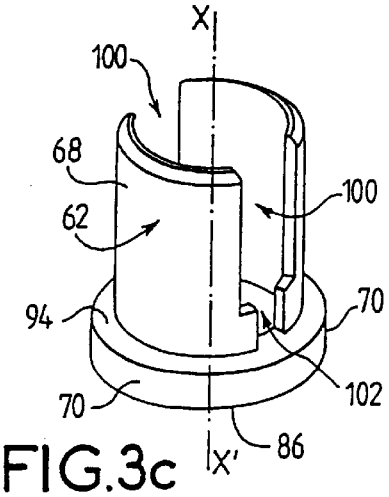
FIG. 3*c* is a perspective view of the guide of the sensor shown in FIG. 3*a,* according to the invention.

FIG. 3*c* is a perspective view of the guide 62 comprising the two position grooves 102.

Of the tabs 98, FIG. 3*b* shows two 104 bent almost horizontal either side of the first axis XX'. The bent tabs 104 fitting into the two respective position grooves 102 in order to prevent the guide 62 rotating in the body 64 of the sensor.

The choice of which two tabs are bent 104 either side of the first axis XX determines the angular position of the guide with respect to a reference direction of the body (which is fixed to a frame) and consequently the angular position of the roller 12 with respect to this reference direction.

Specifically, the guide must be oriented in such a way that the two position grooves 102 are lined up with the two opposing tabs selected for bending. In this embodiment the locator 88 possesses eight tabs spaced at an angular pitch α equal to 45 degrees. The locator can therefore be oriented in the body with angular increments of 45 degrees.

The angular position β of the guide grooves 100 and consequently that of the roller 12 sliding in these grooves, with respect to the body of the sensor, will be determined by which two opposing tabs are selected to be bent into the two position grooves 102.

Figure 3D:
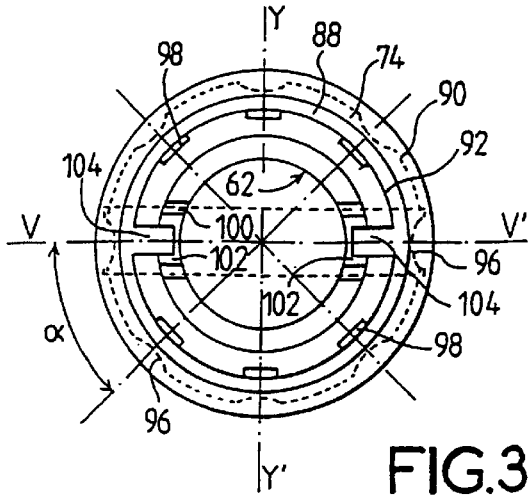
FIG. 3*d* is a simplified top-down view of the sensor shown in FIG. 3*a,* according to the invention.

The drawing of FIG. 3*d* is a simplified top-down view taken on BB' of the position sensor 60, showing the position of the roller 12 with respect to a reference axis VV' passing through the first axis XX' and the middle of a locking groove 106 laid in the body of the sensor parallel to the first axis XX'.

In this illustrative embodiment, the position sensor is fixed with respect to the direction of movement of the moving part by the way it is mounted on a frame 108. For this purpose, the body of the sensor comprises on its circular cylindrical surface, a screwthread 110 and the locking groove 106 parallel to the first axis XX'. A position-defining washer 112 surrounding the body of the sensor comprises on its inner edge an internal bend 114 which fits into the locking groove 106 and an external bend 116 designed to be inserted into a cavity 118 in the frame 108. Two nuts 120 and 122 screwed onto the body either side of the position-defining washer 112 clamp this washer against the frame so that the external bend 116 fits into the cavity 118 of the frame 108 and prevents the body of the sensor rotating in the frame.

Two lock washers (not shown in the Figure) can be placed between the clamping nuts 120 and 122 and the frame 108 in order to ensure that the fixing of the sensor to the frame is as reliable as possible.

The embodiment of the locator is not restricted to the example described and other pitches can be chosen within the limits of the possible ways of constructing the locator and the guide. For example, a pitch of 30 degrees results in a locator having 12 regularly spaced tabs.

The locator 88 will be made in a material that will allow the tabs to be bent almost horizontal and unbent to the initial vertical position to allow for the angular position of the roller to be changed a large number of times. As an example, the locator may be made of stainless steel.

The embodiments of the locator 88 and of the guide 62 are not restricted to the embodiments described. In other embodiments of the position sensor, the locator possesses several tabs and the guide a single position groove 102, one of the bent tabs fitting into the single position groove 102, which means that angular pitches a can be used that do not necessarily give rise to two opposing tabs on either side of the first axis XX'.

A wiper seal 124 situated at the lower end of the guide in an internal circular surface 126 of the said guide is held in position in the guide by the washer 80. An O-ring 128 is placed in the second recess 76. The wiper seal 124 and the O-ring 128 grip the plunger 66, allowing it to slide inside the guide and inside the body of the sensor while preventing leaks between the inside of the sensor body and the external environment.

In other applications of the position sensor according to the invention, the moving part has a slot, the position of which must be detected. For this purpose the free end of the plunger projecting from the guide comprises a lever (not shown) integral with the plunger. As with the roller, the lever must be able to be oriented and in this application the lever must be oriented in the direction of the length of the slot of the moving part, so that it can fit into the slot of the moving part as it moves. The position sensor according to the invention is excellent in this type of application.

The position sensor according to the invention has many advantages over the position sensors of the prior art, namely:

- reduced size owing to the disappearance of the systems for locking the locator, e.g. the locking nuts;
- a limited number of parts, reducing the cost of manufacture and the reliability of the product;
- ability to be used in numerous applications in civilian and military industry;
- great reliability in use compared with sensors of the prior art.

What is claimed is:

1. A position sensor for sensing a position of a moving part, comprising:

- a guide that is rotationally orientable in a body about a first axis XX' of rotation, and a plunger sliding without rotation in the guide along the axis XX';
- a locator that prevents rotation of the guide in the body about the axis of rotation, in a given angular position, wherein the locator is fixed nonremovably in the body and in that it possesses either several tabs spaced regularly about the guide and configured to fit into one position groove to immobilize the guide or several position grooves in which one tab can fit to immobilize the guide;
- wherein the tab or tabs are configured to be bent to enable at least one tab to be inserted into a position groove of the guide to prevent rotation of the guide in the body.

2. The position sensor for sensing the position of a moving part as claimed in claim 1, wherein the locator possesses several tabs, two of these tabs bent, one into each of two position grooves of the guide.

3. The position sensor for sensing the position of a moving part as claimed in claim 1, wherein a washer-like locator possesses an outer edge and an inner edge, the locator being crimped by its outer edge into the body of the sensor, coaxially with the first axis XX'.

4. The position sensor for sensing the position of a moving part as claimed in claim 3, wherein the locator possesses notches in its outer edge to make it rotationally nonremovable once crimped into the body, and tabs on its inner edge, the tabs being spaced regularly at an angular pitch $\alpha$ about the first axis XX', faces of the tabs being parallel to the cylindrical surface of the guide.

5. The position sensor for sensing the position of a moving part as claimed in claim 1, wherein the locator possesses eight tabs spaced at an angular pitch $\alpha$ equal to 45 degrees.

6. The position sensor for sensing the position of a moving part as claimed in claim 1, wherein the locator possesses twelve tabs spaced at an angular pitch $\alpha$ equal to 30 degrees.

7. The position sensor for sensing the position of a moving part as claimed in claim 1, wherein the locator is made of stainless steel.

8. The position sensor for sensing the position of a moving part as claimed in claim 1, wherein a free end of the plunger projecting from the guide comprises a roller configured to turn about a spindle of a second axis YY' perpendicular to the first axis XX'.

9. The position sensor for sensing the position of a moving part as claimed in claim 1, wherein a free end of the plunger projecting from the guide comprises a lever integral with the plunger.

10. A position sensor for sensing a position of a moving part, comprising:

a guide that is rotationally orientable in a body about a first axis XX' of rotation, and a plunger sliding without rotation in the guide along the axis XX';

a locator that prevents rotation of the guide in the body about the axis of rotation, in a given angular position, wherein the locator is fixed nonremovably in the body and in that it possesses either several tabs spaced regularly about the guide and configured to fit into one position groove to immobilize the guide or several position grooves in which one tab can fit to immobilize the guide;

wherein the guide, which is of circular cylindrical shape, possesses an upper part and a lower part, the upper part having a smaller diameter than the lower part which fits inside a first recess in the body of the sensor, the first recess, which is of circular cylindrical shape and coaxial with the first axis XX' of rotation, being open in one direction at one end of the body, situated towards a free end of the plunger, and in the other direction to a second recess, coaxial with the first recess and of a same shape, with a diameter slightly smaller than that of the first recess, thus creating a circular shoulder on which a washer sits, the second recess being open to a third recess through which a lower part of the plunger can pass as it slides inside the body, and the lower part of the guide being applied, by a base surface perpendicular to its axis of revolution, against the washer, keeping the guide in a longitudinal position on the first axis XX' in the body of the sensor.

11. The position sensor for sensing the position of a moving part as claimed in claim 10, wherein the locator is crimped into the body of the sensor near its end, in such a way as to clamp the cylindrical lower part of the guide between said locator resting on a circular surface resulting from the intersection of the upper part with the lower part of the guide, and the washer, the guide thus being kept in a longitudinal position on the first axis XX', such that the guide cannot be removed from the body of the sensor, between the locator and the washer.

* * * * *